United States Patent [19]

Matsuo et al.

[11] 4,312,478

[45] Jan. 26, 1982

[54] ELASTIC RAIL FASTENING DEVICE

[75] Inventors: Yoshio Matsuo; Kentaro Matsubara, both of Tokyo, Japan

[73] Assignee: Tetsudo Kizai Kogyo Company Limited, Tokyo, Japan

[21] Appl. No.: 53,985

[22] Filed: Jul. 2, 1979

[30] Foreign Application Priority Data

Feb. 10, 1979 [JP] Japan ..... 54-13854

[51] Int. Cl.[3] ..... E01B 9/66

[52] U.S. Cl. ..... 238/349; 238/315

[58] Field of Search ..... 238/349, 350, 366, 310, 238/283, 284, 351, 354, 317, 217

[56] References Cited

U.S. PATENT DOCUMENTS

| | | | |
|---|---|---|---|
| 3,451,621 | 6/1969 | De Splinter | 238/315 |
| 3,519,205 | 7/1970 | Monclin et al. | 238/349 |
| 3,658,247 | 4/1972 | Serafin et al. | 238/349 |
| 3,870,231 | 3/1975 | Toyama et al. | 238/324 |
| 3,876,141 | 4/1975 | French | 238/349 |
| 3,894,687 | 7/1975 | Jacobson | 238/310 |
| 3,904,114 | 9/1975 | Kasuba | 238/349 |
| 3,970,248 | 8/1976 | Molyneux | 238/349 |
| 4,026,466 | 5/1977 | Duchemin | 238/349 |
| 4,109,860 | 8/1978 | Serafin et al. | 238/349 |
| 4,150,792 | 4/1979 | Rureshi | 238/349 |
| 4,179,067 | 12/1979 | Baier | 238/91 |

FOREIGN PATENT DOCUMENTS

| | | | |
|---|---|---|---|
| 646867 | 3/1937 | Fed. Rep. of Germany | 238/349 |
| 657980 | 7/1938 | Fed. Rep. of Germany | 238/349 |
| 100980 | 4/1962 | Netherlands | 238/349 |
| 114325 | 1/1943 | Sweden | 238/349 |

*Primary Examiner*—Richard A. Bertsch

*Attorney, Agent, or Firm*—Blanchard, Flynn, Thiel, Boutell & Tanis

[57] ABSTRACT

An elastic rail fastening device for securing a rail to a concrete tie having a spike secured therein. A top pressing spring engages the top surface of the rail flange for holding the rail against the tie. One end of the spring is supported beneath a shoulder on the metal spike. A spring receiver is fitted to the tie, and the other end of the top spring bears thereagainst. A side spring is inserted between the side of the rail flange and the spring receiver to receive transverse pressure working on the rail.

16 Claims, 14 Drawing Figures

ELASTIC RAIL FASTENING DEVICE

FIELD OF THE INVENTION

This invention relates to a device for fastening a rail to a concrete tie or the like.

BACKGROUND OF THE INVENTION

In fastening a rail to a concrete tie or the like according to a conventional method, the rail is placed on the tie, with a pad laid between the rail base and the tie. Both edges of the rail base are held by plate springs that are fastened from above to the tie with bolts and nuts. Where many trains run at high speeds, therefore, vibrating rails can loosen the bolts, thereby floating from the tie and causing derailment. Consequently, this type of fastening device has required substantial inspection and maintenance.

Many of the conventional bolt-nut-less fastening devices receive the transverse force, which is exerted by the rail pressed sideward by the wheel, directly with steel spikes preset in the concrete tie. When the transverse pressure becomes excessive, it can break the concrete tie due to the pressure being transmitted through the steel spikes.

To eliminate the aforementioned shortcomings in the conventional fastening devices, this invention interposes a side spring between the rail and the concrete tie. This side spring elastically receives the transverse pressure and thereby keeps the concrete tie free from the excessive force.

DETAILED DESCRIPTION

Figure 1:
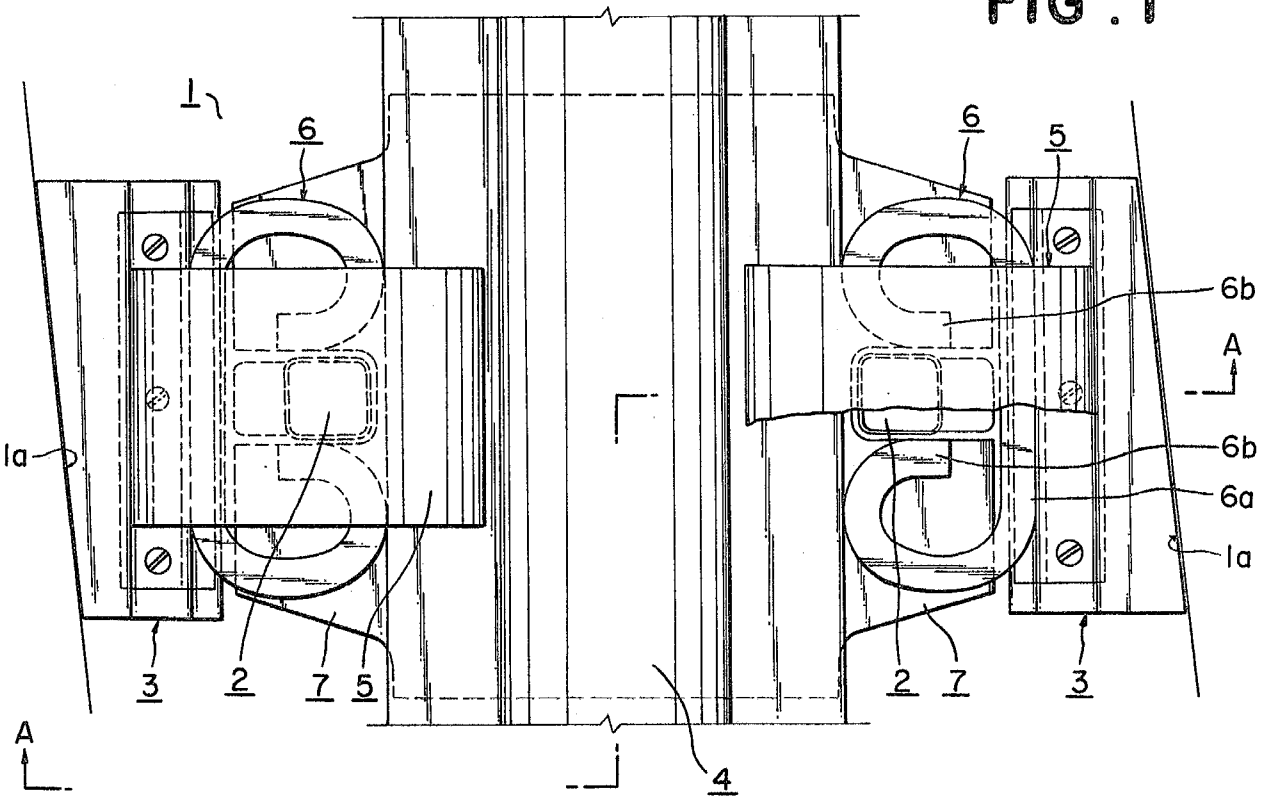
FIG. 1 is a partly cross-sectional plan view showing an embodiment of the elastic rail fastening device according to this invention.
Figure 2:
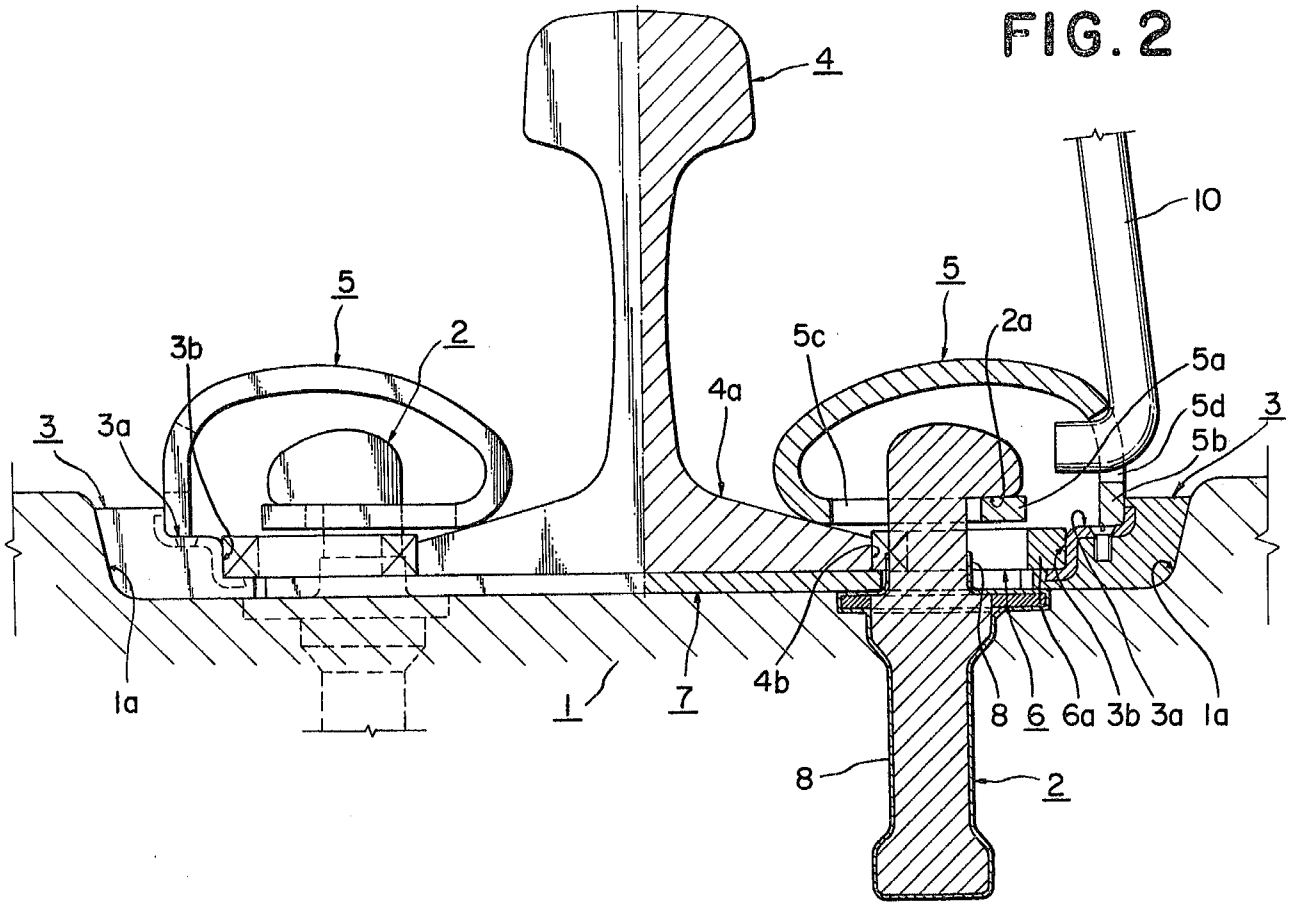
FIG. 2 is a cross-sectional elevation viewed along the lie A—A of FIG. 1.

As shown in FIGS. 1 and 2, a rail fastening device according to this invention includes a top pressing spring 5 which is supported at one end by being held under the sidewardly projecting chin 2*a* formed at the top of a steel spike 2, which spike is fixedly buried in a concrete tie 1. The other end of spring 5 is supported by the upper step 3*a* of a spring receiver 3. The lower side of the upturned portion of the spring 5 holds the flange top 4*a* of a rail 4. The spring receiver 3 is longitudinally wedge-shaped, with the back thereof adapted to contact the raised edge 1*a* of the concrete tie 1. The fastening device also comprises a side spring 6 that is inserted between the lower step 3*b* of the spring receiver 3 and the flange side 4*b* of the rail 4.

Figure 3:
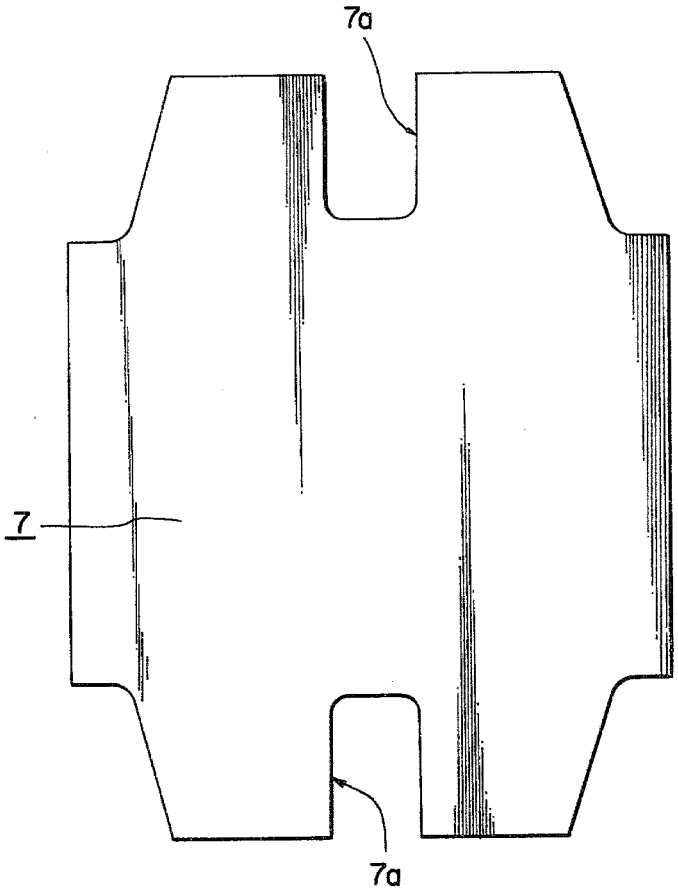
FIG. 3 is a plan view of a pad.
Figure 4:
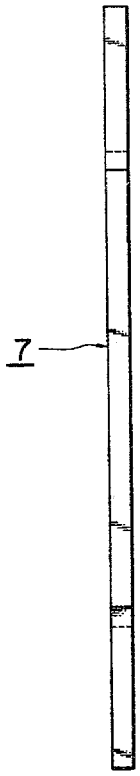
FIG. 4 shows the right side of the pad.

To be more precise, the rail 4 is transversely laid on the scooped or recessed portion of the concrete tie 1, with a pad 7 of insulating material interposed therebetween. As seen in the plan view of FIG. 1, the raised edges 1*a* at both ends of the recessed portion of the concrete tie 1 extend aslant at a slight angle relative to the longitudinal direction of the rail, but parallel to each other. The pad 7 is made of an elastic, electrically insulating substance. As shown in FIGS. 3 and 4, the pad 7 has opposed notches 7*a* to avoid interference by the steel spikes 2. At the same time, the steel spikes 2 as positioned in the notches 7*a* prevent the movement of the pad 7.

Figure 5:
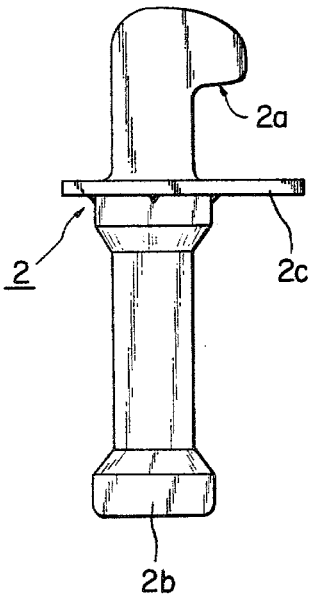
FIG. 5 is a side elevation of a steel spike.
Figure 6:
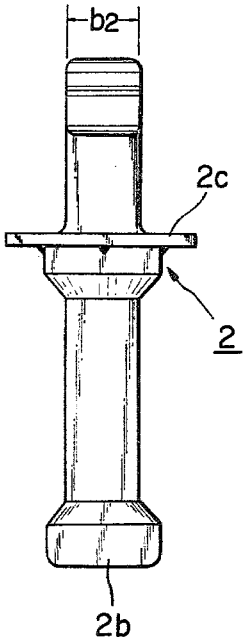
FIG. 6 shows the right side of the spike.

The steel spike 2 (which may be made of other metals than steel) is preset in the recessed portion of the concrete tie 1. As shown in FIGS. 5 and 6, the steel spike 2 has an enlarged lower portion 2*b* to prevent slip-out at its lower end when embedded in the tie, a flange 2*c* welded midway, and a top projection 2*a* facing away from the rail. The portion below the middle flange 2*c* is buried in the concrete tie 1. Coated with synthetic resin 8 etc., this buried portion is electrically insulated from the concrete tie 1.

Figure 7:
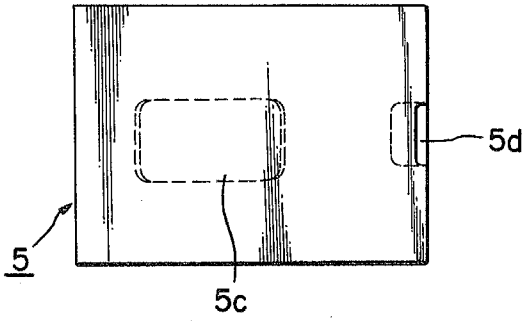
FIG. 7 is a plan view of a top pressing spring.
Figure 8:
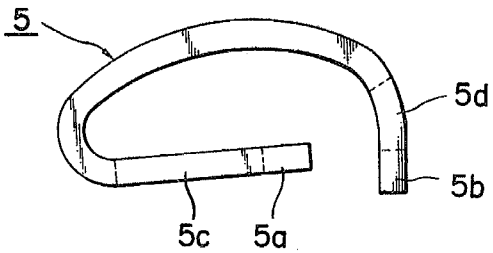
FIG. 8 is a side elevational view of the top spring.

The top pressing spring 5 depresses the flange top 4*a* of the rail 4. As shown in FIGS. 7 and 8, the top pressing spring 5 comprises a sheet of elastic material, such as spring steel, which is bent into a substantially elliptical shape, thus being bent through approximately 270° as illustrated. In the middle of one free end thereof, which constitutes the bottom when bent, there is formed a rectangular opening 5*c* to pass therethrough the head of the steel spike 2. An opening 5*d* (FIGS. 7 and 8) to catch the hook 10 of an installation tool 9 (FIG. 14) is provided in the side of the spring opposite to the rail. The other free end 5*b*, close to which the opening 5*d* is perforated, is projected below the horizontal extension of the opposite free end 5*a*. The top pressing spring need not always be shaped as described above, but in any way so far as it can depress the rail flange top 4*a*, with one end thereof supported by the steel spike.

Figure 9:
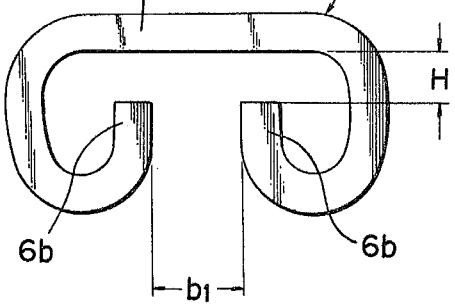
FIG. 9 is a plan view of a side spring.
Figure 10:
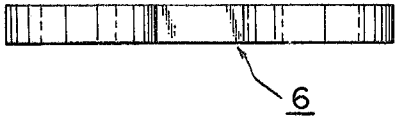
FIG. 10 is a side elevational view of the side spring.

The side spring 6 is placed between the flange side 4*b* of the rail 4 and the lower step 3*b* of the spring receiver 3. As shown in FIGS. 9 and 10, the side spring 6 is a square bar of elastic material shaped like a spectacle frame. That is, spring 6 is formed from an elongated straight bar, with the ends being bent inwardly to form a pair of adjacent partial loops. The straight portion 6*a* thereof rests on the spring receiver 3. Desirably, the internal width $b_1$ between the two curved ends or loops of the side spring 6 is equal to, or slightly greater than, the width $b_2$ of the steel spike 2. The two free ends 6*b* are spaced at the same distance H from the straight portion 6*a* so as to effectively perform the function of a spring.

Figure 11:
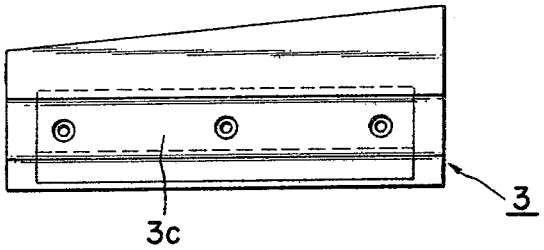
FIG. 11 is a plan view of a spring receiver.
Figure 12:
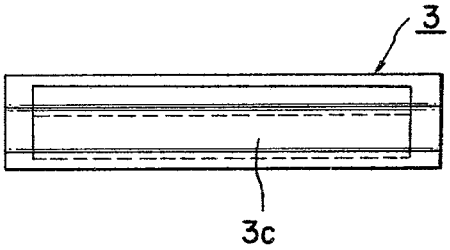
FIG. 12 is a side elevational view of the spring receiver.
Figure 13:
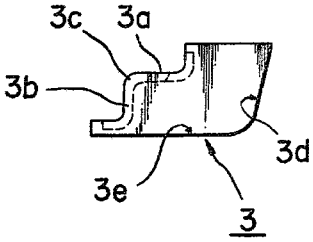
FIG. 13 shows the right end of the spring receiver.

The spring receiver 3 of electrically insulating material has two steps 3*a* and 3*b* on its rail side, as shown in FIGS. 11 to 13. A replaceable, stepped angle 3*c* is fastened with screws to the surface of the receiver. The spring receiver 3 is longitudinally wedge-shaped. The back 3*d* and the bottom 3*e* of the receiver 3 are so shaped as to fit the edge of the recessed portion of the concrete tie 1.

OPERATION

To fasten a rail 4 with the device of this invention, the pad 7 is placed so that the notches 7*a* contain the steel spikes 2 as preset in the recessed portion of the concrete tie. The rail 4 is then placed in position on the pad.

Figure 14:
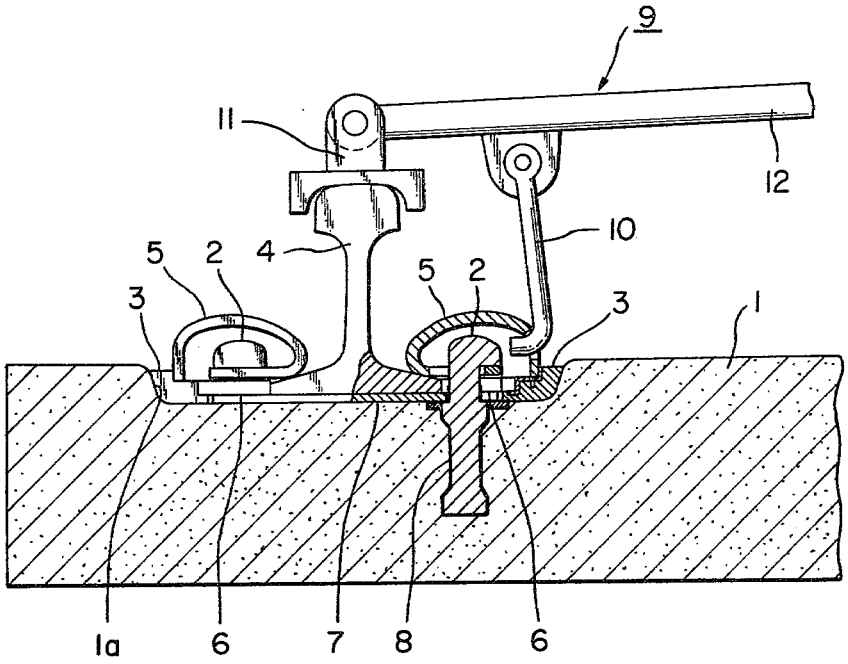
FIG. 14 schematically illustrates how the device of this invention is fitted by use of an installation tool.

Next, the side spring 6 is placed so that the curved ends of loops thereof hold the spike therebetween with the fronts of these loops contacting the flange side 4*b* 1 of the rail 4. The head of the steel spike 2 is then passed through the rectangular opening 5*c* in the bottom of the top pressing spring 5 so that the one free end 5*a* thereof is supported under the projecting chin or shoulder 2*a* of the steel spike. The hook 10 of the installation tool 9 is inserted in the opening 5*d* in the other free end of spring 5. As shown in FIG. 14, a rail grip or channel 11 at the remote end of the tool 9 is placed on the rail 4. The tool lever 12 is then urged upwardly (counterclockwise in FIG. 14) so that hook 10 exerts a lifting force on the spring end 5*b*, and the spring receiver 3 is slid along the edge 1*a* of the tie 1, with the tapered end thereof at the head. The side spring 6 is placed on the lower step 3*b* of the receiver 3. By lowering the lever 12 of tool 9, the free end 5*b* of the top pressing spring 5 is placed on the upper step 3*a* of the receiver 3 (FIG. 2). The tool 9 is then detached. This work is done on both sides of the rail 4. The rail flange tops 4*a* are thus depressed from both sides by the bottom of the upturned top pressing springs 5, and the flange sides 4*b* held between the side springs 6, thus fastening the rail 4 in position.

As evident from the above description, the fastening device of this invention depresses the rail flange top with the top pressing springs and holds the rail flange sides between the side springs. This permits securing the rail to the tie. Further, it prevents the breaking of the concrete tie, with the side springs 6 springs 6 elastically receiving the transverse pressure exerted by the running wheels along the rail.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An elastic rail fastening device for securing an elongated rail to a concrete base, the elongated rail being positionable on top of the base and having bottom flanges projecting outwardly from opposite sides thereof, the concrete base having metal spikes embedded therein and projecting upwardly therefrom on opposite sides of said rail, said spike defining thereon a downwardly directed shoulder, said fastening device comprising:

a spring receiver removably fitted to said concrete base in sidewardly spaced relationship from said rail, said spike being positioned between said spring receiver and said rail;

a curved platelike pressing spring having one end thereof supported on and engaged with the shoulder of said spike, the other end of said pressing spring being supported on and engaged with said spring receiver;

said pressing spring having a configuration similar to a partial loop and being bent through an angle of approximately 270°;

said pressing spring also having an intermediate portion thereof in pressing engagement with an upper surface of the rail bottom flange for urging said flange downwardly against said concrete base, the intermediate portion of the pressing spring, at its point of engagement with the bottom flange of the rail, being spaced inwardly toward the rail from said spike, whereby said one end of said pressing spring and its point of engagement with said spike is disposed sidewardly between said intermediate portion and said other end;

said pressing spring having an opening formed therethrough closely adjacent but spaced slightly inwardly from said one end thereof, said spike passing through said opening so that said pressing spring directly adjacent said one end thereof can be positioned directly beneath said shoulder; and a side spring inserted and engaged between the side of said bottom flange and said spring receiver to receive the transverse pressure as applied on the rail.

2. A rail fastening device according to claim 1, wherein said side spring includes a straight portion which extends substantially parallel to the rail and bears against the spring receiver, said straight portion terminating in a pair of partial loops which are symmetrical and spaced apart so as to permit the spike to be positioned therein, said partial loops bearing against the side of said bottom flange.

3. A rail fastening device according to claim 1, wherein the concrete base has a shallow recessed portion in which said rail is positioned, said recessed portion extending transversely relative to the rail and terminating in upwardly projecting shoulder portions on the base which are spaced outwardly from opposite sides of the rail, said spring receiver being positioned within said recessed portion adjacent an end thereof so as to bear against the raised shoulder portion of the base.

4. A rail fastening device according to claim 3, wherein the spring receiver defines an elongated shoulder which extends at a slight angle relative to the longitudinally extending direction of the rail so as to create a wedging engagement with the pressing and said springs.

5. In an elastic rail fastening device for securing an elongated rail to a support base, the elongated rail being positionable on top of the base and having bottom flanges projecting outwardly from opposite sides thereof, the base having spikes fixed thereto and projecting upwardly therefrom on opposite sides of said rail, each said spike having a head portion fixedly and integrally associated therewith and defining thereon a downwardly-directed support surface, said spikes being spaced outwardly from the side edges of said base flanges, and the base having a spring receiver thereon in sidewardly-spaced relationship from said bottom flange so that said spike is positioned therebetween, said spring receiver having an upwardly-facing abutment surface, comprising the improvement wherein:

a curved one-piece platelike pressing spring coacts between said spring receiver, said spike and said bottom flange for resiliently engaging the upper surface of said bottom flange for pressing said flange downwardly for secure connection of same to said base;

said spring receiver being removably fitted on said base to permit the pressing spring during installation to be initially engaged with the spike and the base flange and then resiliently deflected for engagement with said spring receiver;

said pressing spring including a U-shaped configuration which includes upper and lower leg portions which are integrally joined together by an intermediate curved bent portion;

said upper leg portion being positioned above the head portion of said spike and terminating in a free edge portion at one end thereof, which said free edge portion bears against the abutment surface on said spring receiver, said intermediate bent portion having an outer downwardly-directed surface thereon which is urged into gripping engagement with the upper surface of the bottom flange for urging the latter downwardly, and the lower leg portion having an upper surface thereon maintained in bearing engagement with the downwardly-directed support surface formed on the head portion of said spike;

said upper and lower leg portions respectively reacting against said abutment and support surfaces so that said leg portions are maintained in a condition wherein they are resiliently deflected away from one another so that the intermediate bent portion reacts downwardly against said bottom flange.

6. A fastening device according to claim 5, wherein the lower leg portion of the pressing spring has an opening formed therethrough, said spike passing through said opening so that the upper surface of said lower leg portion can be positioned directly beneath the support surface formed on the head portion of said spike.

7. A fastening device according to claim 5 or claim 6, wherein the integral head portion of the spike includes an integral chin portion which projects horizontally sidewardly, said chin portion defining said support surface thereunder.

8. A fastening device according to claim 5, wherein the lower leg portion is substantially horizontally planar, and wherein the upper leg portion includes an elongated portion which is spaced upwardly from and passes over the head portion of the spike and terminates in a downwardly curved portion which defines said free edge portion and is disposed in bearing engagement with said abutment surface.

9. A fastening device according to claim 8, wherein the downwardly curved portion of said upper leg portion has an opening therethrough for accommodating therein a tool for permitting expansion of the pressing spring during installation thereof.

10. A fastening device according to claim 5 or claim 9, wherein the U-shaped configuration of the pressing spring is similar to a partial loop and is bent through an angle of approximately 270°.

11. An elastic rail fastening device for securing an elongated rail to a concrete base, the elongated rail being positionable on top of the base and having bottom flanges projecting outwardly from opposite sides thereof, the concrete base having a shoulder thereon which is spaced sidewardly from the rail so that the shoulder faces but is spaced from the opposed side edge of the base flange, a metal spike embedded in the concrete base and projecting upwardly therefrom in sidewardly spaced relationship from the base flange so that the spike is interposed between the base flange and the shoulder, said spike having a head portion defining thereon a downwardly-directed support surface, and a spring receiver removably fitted to the concrete base in sidewardly spaced relationship from the bottom flange so that the spring receiver bears against the shoulder, the spring receiver having an inner side surface which is disposed opposite but spaced outwardly from the side edge of the base flange, the spring receiver and shoulder having a cammed relationship therebetween so that the spacing between the side edge of the flange and the inner side surface of the spring receiver varies in response to the position of the spring receiver on the base, the improvement wherein said fastening device comprises:

first spring means for imposing a downwardly-directed holding force against the upper surface of the base flange, said first spring means comprising a first spring member having a first portion thereof disposed in bearing engagement with and imposing a downwardly-directed force against an upper surface formed on said spring receiver, a second portion disposed in bearing engagement with the upper surface of said base flange for imposing a downwardly-directed force thereagainst, and a third portion disposed in bearing engagement with the downwardly-directed support surface formed on said spike;

said head portion being integrally and fixedly associated with said spike so that said first spring member reacts between said spike and said base flange without requiring use of a removable or threaded head portion on the spike; and second spring means coacting with the base flange of the rail for transmitting sidewardly-imposed external forces on the rail directly to the shoulder on the base without imposing these sidewardly-directed forces on the spike, said second spring means comprising a second spring member which is wholly independent of said first spring member and is capable solely of transmitting sidewardly-directed forces from the rail to the shoulder;

said second spring member including a first part disposed in bearing engagement with the inner side surface of said spring receiver, and a second part disposed in bearing engagement with the inner edge of said rail flange, said second spring member being free of connection with said spike to prevent the sidewardly-directed forces transmitted through said second spring member from being imposed of said spike.

12. A fastener according to claim 11, wherein the second part of said second spring member comprises an elongated and substantially straight central base portion which is disposed in bearing engagement with the inner side surface of said spring receiver, and the first part of said second spring member comprising a pair of bent end portions which are integrally fixed to and project inwardly from the opposite ends of the base portion so that the pair of bent end portions bearingly engage the side edge of the base flange at a pair of locations disposed on opposite sides of said spike.

13. A fastener according to claim 12 wherein the pair of end portions have means associated therewith for closely embracing the opposite sides of the spike in the longitudinal direction of the rail for preventing the second spring member from being displaced relative to the spike in said longitudinal direction.

14. A fastener according to claim 12 or claim 13, wherein the bent end portions comprise partial loops which are symmetrical and bent inwardly toward one another but are spaced apart by a distance sufficient to accommodate the spike therebetween.

15. A fastener according to claim 12, wherein said first spring member includes a substantially U-shaped configuration which includes upper and lower leg portions which respectively define the first and third portions, said upper and lower leg portions being joined by an intermediate curved bent portion which defines said second portion, said upper leg portion being positioned above the head portion of said spike and terminating in a free edge portion at one end thereof which bears downwardly against the upper surface of said spring receiver.

16. A fastener according to claim 15, wherein the U-shaped configuration defines a partial loop which is bent through an angle of approximately 270°, wherein the intermediate bent portion has its outer downwardly-directed surface urged into gripping engagement with the upper surface of the bottom flange for imposing a downward holding force thereon, and the lower leg portion is substantially horizontally planar and is maintained in bearing engagement with the downwardly-directed support surface formed on said spike.

* * * * *

UNITED STATES PATENT AND TRADEMARK OFFICE

CERTIFICATE OF CORRECTION

PATENT NO. : 4 312 478

DATED : January 26, 1982

INVENTOR(S) : Yoshio Matsuo and Kentaro Matsubara

It is certified that error appears in the above—identified patent and that said Letters Patent is hereby corrected as shown below:

Column 4, line 40; change "said" to ---side---.

Column 6, line 41; change "of" to ---on---.

Signed and Sealed this

*Tenth* Day of *August 1982*

[SEAL]

*Attest:*

GERALD J. MOSSINGHOFF

*Attesting Officer* *Commissioner of Patents and Trademarks*